US009522398B2

(12) United States Patent
Van Meerbergen et al.

(10) Patent No.: US 9,522,398 B2
(45) Date of Patent: Dec. 20, 2016

(54) HEATER FOR A DISPOSABLE DIAGNOSIS CARTRIDGE

(71) Applicant: BIOCARTIS NV, Mechelen (BE)

(72) Inventors: Bart Van Meerbergen, Sint-Job-in-'t-Goor (BE); Roel Penterman, Tisselt (BE); Nicolas Vergauwe, Borgloon (BE)

(73) Assignee: BIOCARTIS NV, Mechelen (BE)

( * ) Notice: Subject to any disclaimer, the term of this patent is extended or adjusted under 35 U.S.C. 154(b) by 0 days.

(21) Appl. No.: 14/413,574

(22) PCT Filed: Jun. 27, 2013

(86) PCT No.: PCT/EP2013/063555

§ 371 (c)(1),
(2) Date: Jan. 8, 2015

(87) PCT Pub. No.: WO2014/009168

PCT Pub. Date: Jan. 16, 2014

(65) Prior Publication Data

US 2015/0182965 A1 Jul. 2, 2015

(30) Foreign Application Priority Data

Jul. 9, 2012 (EP) ..... 12175582

(51) Int. Cl.
*B01L 9/00* (2006.01)
*B01L 7/00* (2006.01)
*B01L 3/00* (2006.01)

(52) U.S. Cl.
CPC ..... *B01L 7/52* (2013.01); *B01L 3/505* (2013.01); *B01L 2200/0684* (2013.01);
(Continued)

(58) Field of Classification Search
CPC ..... B01L 7/52; B01L 3/505; B01L 2200/0684; B01L 2300/123; B01L 2300/1805
(Continued)

(56) References Cited

U.S. PATENT DOCUMENTS

| | | | | |
|---|---|---|---|---|
| 5,224,536 | A | 7/1993 | Eigen et al. | 165/32 |
| 2006/0088931 | A1* | 4/2006 | Ririe | 435/304.1 |
| 2010/0104485 | A1 | 4/2010 | Yuan | 422/198 |

FOREIGN PATENT DOCUMENTS

| | | | |
|---|---|---|---|
| EP | 2 182 049 | 5/2010 | C12M 1/00 |
| WO | WO 2009/149115 | 12/2009 | B01L 3/00 |

(Continued)

OTHER PUBLICATIONS

International Search Report for International Application No. PCT/EP2013/063555, Aug. 20, 2013.

(Continued)

*Primary Examiner* — Jill Warden
*Assistant Examiner* — Dwayne K Handy
(74) *Attorney, Agent, or Firm* — Kusner & Jaffe

(57) ABSTRACT

System for performing biological analysis comprising: a cartridge having a deformable chamber suitable for containing a liquid to be analyzed; a heater having a heating face arranged to heat the liquid contained in the deformable chamber; characterized in that the heating face of the heater is moveable from a first position to at least a second position, different from the first position, to allow an increase of volume of said deformable chamber in order to compensate an increase of pressure in the deformable chamber during the heating of said liquid by said heater.

9 Claims, 1 Drawing Sheet

(52) U.S. Cl.
CPC . *B01L 2300/123* (2013.01); *B01L 2300/1805* (2013.01); *B01L 2400/0481* (2013.01)

(58) Field of Classification Search
USPC ..... 422/560
See application file for complete search history.

(56) References Cited

FOREIGN PATENT DOCUMENTS

| | | | | |
|---|---|---|---|---|
| WO | WO 2009149115 | * | 12/2009 | |
| WO | WO 2011/048521 | | 4/2011 | ..... B01L 3/00 |
| WO | WO 2011048521 | * | 4/2011 | |

OTHER PUBLICATIONS

"PCR Processor," Research Disclosure, Mason Publications, Hampshire, GB, No. 396, Apr. 1, 1997, pp. 207-2011.

* cited by examiner

HEATER FOR A DISPOSABLE DIAGNOSIS CARTRIDGE

FIELD OF THE INVENTION

The present invention relates to a system for performing biological analysis.

BACKGROUND OF THE INVENTION

Typically, systems for performing biological analysis comprise a cartridge designed to hold the biological sample and comprise fluidic circuits to prepare and isolate the desired elements from the biological sample to perform specific analysis such as DNA analysis. These systems also comprise an instrument containing the analysis means and arranged to command and control the cartridge so that the latter may be simplified and designed to be used one time only and thrown away after use.

For instance, the document WO2009149115A1 discloses a cartridge for performing biochemical assays and having a deformable chamber. In the deformable chamber, some chemical operations are performed on a liquid containing the substances to be analyzed. Some air may be injected in the chamber to perform an agitation, thus increasing the pressure, and the valves of the deformable chamber shall be designed to withstand this pressure, to avoid any loss of liquid. It leads to either an increase of cost to design such secured valves, or to a loss of reliability of the test if some liquid is lost.

The document WO 2011048521 describes a system for performing DNA analysis which comprises an instrument operating a disposable cartridge that holds a liquid containing the biological sample. The cartridge is maintained onto an interface plate of the instrument by a vacuum force applied by the instrument onto the cartridge. The external face of the cartridge in contact with the interface plate is at least partially formed by an elastic membrane having a portion on which the vacuum is applied. To analyze the biological sample, a step of heating the liquid contained in said cartridge may be required. A chamber containing said liquid is arranged in the cartridge so that at least a wall of the chamber is formed by a portion of the membrane and a heater is arranged in the interface plate to contact said wall of the chamber and to heat the liquid. However, this solution leads to issues when air bubbles are contained in the liquid in the chamber. Indeed, during the heating, the air bubbles expand, so that the pressure increase inside the chamber, leading either to leaks in the circuit (resulting in a loss of the biological sample) or to a detachment of the cartridge from the instrument plate (resulting in an abortion of the analysis).

The document EP2182049A1 discloses a container for liquid reaction mixture, a reaction-promoting device using the same, and a method therefor. However, the container and device disclosed are complicated to manufacture and to use, as the device has a lower part and an articulated upper part, to clamp the container.

The document US2010104485A1 discloses a flow-through thermal cycling device comprising two opposite heaters in regards to a flexible chamber. A drawback of this device is the associated complexity of the heating device, as the flexible chamber shall be inserted between the opposite heaters.

The document US2006088931A1 discloses a thermal cycling system and vessel therefor, comprising two opposite heaters in regards to a flexible chamber. A drawback of this device is the associated complexity of the heating device, as the flexible chamber shall be inserted between the opposite heaters.

SUMMARY OF THE INVENTION

The present invention aims to solve these aforementioned drawbacks and is directed to propose first a system for biological analysis comprising a cartridge having a chamber suitable for containing a liquid to be analyzed, a heater arranged to heat the liquid, the system being arranged so that the heating of a liquid contained in the chamber will not lead to leaks through the valves during the analysis.

With this goal in mind, a first aspect of the invention is a system for performing biological analysis comprising:

- a cartridge having a deformable chamber suitable for containing a liquid to be analyzed;
- a heater having a heating face arranged to heat the liquid contained in the deformable chamber;

characterized in that the heating face of the heater is moveable from a first position to at least a second position, different from the first position, to allow an increase of volume of said deformable chamber in order to compensate an increase of pressure in the deformable chamber during the heating of said liquid by said heater.

The present invention improves the reliability of the assay as the pressure in the chamber containing a liquid is compensated by an increase of volume which is possible due to the moveable heating face of the heater. The valves will not be stressed by the pressure since there is no increase of pressure during the heating, so that any leakage will be avoided.

Advantageously, the heating face of the heater is moved during the heating by the deformable chamber from the first position to the second position. The system does not require any actuation of the heating face to achieve the movement from the first position to the second position, as the movement is forced by the deformable chamber itself.

Advantageously, the heating face is in contact with the deformable chamber during the heating of the liquid. The heating is efficient with this embodiment where the heat is transferred to the liquid contained in the chamber by conduction.

Advantageously, the system comprises an instrument having an interface plate, arranged to control the cartridge and to maintain the cartridge onto the interface plate, during the biological analysis, and the heater is arranged in the instrument interface plate. The analysis operation will not be interrupted by any release of the cartridge from the instrument, as the moveable heater inside the interface plate will move away from the cartridge, avoiding the creation of any dismantling effort onto the cartridge that would have been created by an increase of volume of the deformable chamber having its movements limited by the interface plate.

Advantageously, the instrument comprises an elastic element arranged to push the heater against the deformable chamber. This embodiment improves the contact between the heater and the deformable chamber.

Advantageously, the instrument comprises command means arranged

- to allow the heating face of the heater to move from the first position to the at least second position during the heating of the liquid, and
- to maintain the heating face of the heater at the first position when other operations than heating the liquid are performed. The command means adapted to force the heating face to be in the first position during other operation than heating help to avoid any deflection or variation of volume of the deformable chamber. The pumping operations are reliable as the volume of the deformable chamber does not expand, because the heating face of the heater is in the first position.

Advantageously, the command means are a pneumatic cylinder. This embodiment is cost effective for manufacturing the system.

Advantageously, the cartridge is maintained onto the interface plate by a vacuum force applied by the instrument onto the cartridge. No mechanical means such as clamps or gripping tools are necessary to control the attachment between the cartridge and the instrument.

Advantageously, the cartridge comprises an elastic membrane arranged on an external face of the cartridge, a portion of the elastic membrane is a wall of the deformable chamber, the deformable chamber comprises a filter and the heating face of the heater is arranged to push the portion of the elastic membrane forming the wall against the filter during an operation of wetting the filter. This arrangement minimizes the risk of having air bubbles in the deformable chamber as its volumes is reduced to the minimum during the wetting operation of the filter with the deformable membrane in contact with the filter. In other words, the heater may be used as control means for creating a movement or displacement of the fluid contained in the deformable chamber.

Advantageously, the heater is deformable. This embodiment avoids having a moveable heater, thus, the interface plate is simpler as the heating face is deformed by the increase of volume of the deformable chamber, without any movement of the body of the heater.

As an alternative, the heater is arranged in the cartridge. This embodiment allows a simplification of the instrument.

The invention is also related to an instrument for a system according to the first aspect of the invention, and comprising a heater having a heating face arranged to heat the liquid contained in the deformable chamber, characterized in that the heating face of the heater is moveable from a first position to at least a second position, different from the first position, to allow an increase of volume of said deformable chamber in order to compensate an increase of pressure in the deformable chamber during the heating of said liquid by said heater.

The invention is also related to a cartridge for a system according to the first aspect of the invention, and comprising a heater having a heating face arranged to heat the liquid contained in the deformable chamber, characterized in that the heating face of the heater is moveable from a first position to at least a second position, different from the first position, to allow an increase of volume of said deformable chamber in order to compensate an increase of pressure in the deformable chamber during the heating of said liquid by said heater.

The invention is also related to a process for heating a liquid contained in a deformable chamber of a cartridge for biological analysis, comprising the steps consisting of:

heating the liquid with a heating face of a heater;

moving the heating face of the heater from a first position to at least a second position, different from the first position, to allow an increase of volume of said deformable chamber in order to compensate an increase of pressure in the deformable chamber during the heating of said liquid by said heater.

Other characteristics and advantages of the present invention will appear more clearly from the following detailed description of particular non-limitative examples of the invention, illustrated by the appended drawings.

DETAILED DESCRIPTION OF THE INVENTION

Figure 1:
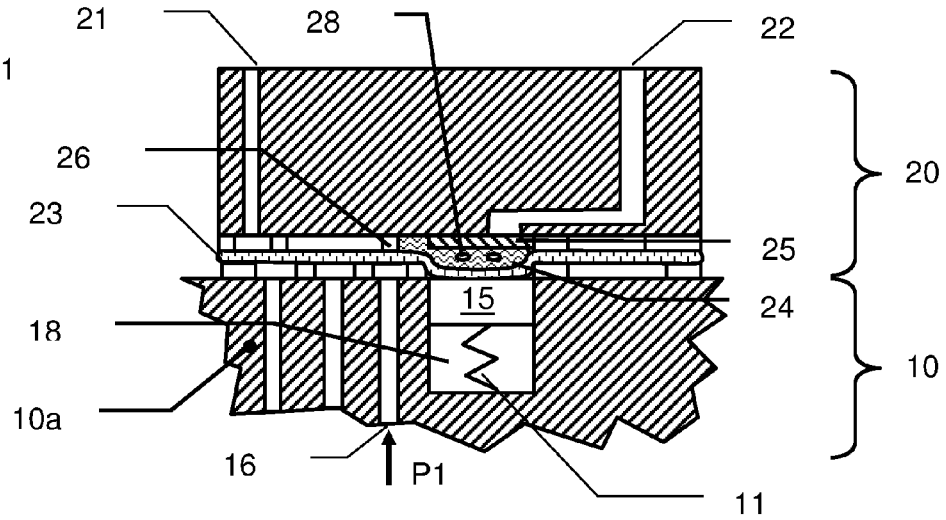
FIG. 1 represents a system according to the invention, with a cartridge attached to an instrument having a moveable heater, before heating a liquid contained in a deformable chamber of the cartridge.

The system represented at FIG. 1 comprises an instrument 10 and a disposable cartridge 20 that is attached to an interface plate 10*a* of the instrument 10 prior to performing biological analysis. The cartridge 20 comprises an elastic membrane 23 covering at least partially its lower face, which is in contact with an interface plate of the instrument 10. The cartridge 20 is maintained in place onto the interface plate 10*a* by the application of a vacuum force on a portion of its lower face (not represented). The cartridge 20 comprises an inlet 21 connected to an outlet 22 via a deformable chamber 24 designed to contain a liquid. The deformable chamber 24 has at least a wall formed by a portion of the elastic membrane 23. The deformable chamber 24 contains a filter 25. It is closable thanks to an inlet valve 26, under the application of a pressure P1 through the channel 16 of the instrument 10, and thanks to an outlet valve (not shown), functioning under the same principle of pressure applied from the instrument 10.

To perform an assay, the deformable chamber 24 is first at least partially filled with a liquid containing a biological sample on which analysis will be performed, such as DNA analysis, and then closed thanks to the inlet and outlet valves. Depending on the analysis, it may be required to heat said liquid prior and or during the analysis. To this end, a moveable heater 15 is provided in a recess 18 or bore of the instrument 10 with an elastic element 11 such as a spring placed between the bottom of said recess 18 and the heater 15. The heater 15 may move vertically in the recess 18, with guiding means if necessary. The heater 15 has a heating face positioned and designed to be in contact with the elastic membrane 23 when the cartridge 20 is attached to the instrument 10 in view of an analysis. For example, the heating face of the heater 15 is parallel to the face of the instrument in contact with the cartridge so that the heating face will contact the cartridge as soon the latter is attached to the instrument. An alternative may be that the heater is arranged below the contact face of the instrument and is moved upwardly to contact the cartridge only when heating is necessary. The heater 15 is capable of heating the liquid contained in the deformable chamber 24. The elastic element 11 is designed so that the heater 15 will remain in contact with the deformable chamber. During the process to fill the deformable chamber 24 with the liquid, some air bubbles 28 may be brought into the deformable chamber 24, as shown.

Figure 2:
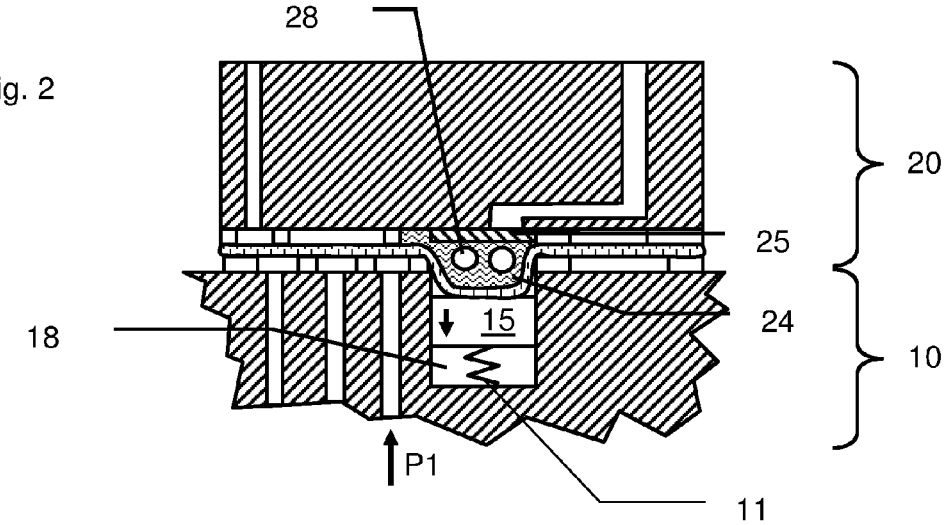
FIG. 2 represents the system of FIG. 1 during the heating of the liquid.

FIG. 2 represents the system of FIG. 1 during the heating of the liquid contained in the deformable chamber 24. A typical heating may be a rising of the temperature from room temperature (i.e. 23° C.) to 95° C. during 10 minutes. Under these conditions, the air bubbles 28 contained in the deformable chamber 24 with the liquid will expand, leading to an increase of volume of the deformable chamber 24. The heater 15, in contact with the portion of the elastic membrane 23 forming a wall of the deformable chamber 24 is pushed down in the recess 18 by the elastic membrane 23, to allow the increase of volume of the deformable chamber 24. The elastic element 11 exerts a force opposing to the displacement of the heater 15 caused by the deformation of the deformable membrane 23. This avoids an increase of pressure inside the deformable chamber that could create leaks of liquid through the valve 26 for example. The stiffness of the elastic element 11 is adapted to maintain the contact between the heater 15 and the elastic membrane 23 to achieve the heating, while maintaining a constant pressure in the deformable chamber.

Figure 3:
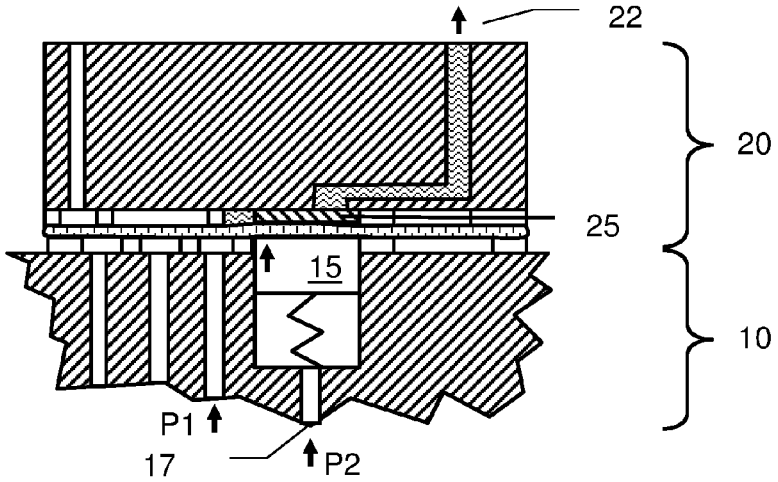
FIG. 3 represents an alternative of the system of FIG. 1 with a heater moveable under a pneumatic command.

FIG. 3 represents an alternative of the system of FIG. 1. The heater 15 can still move vertically under the action of the elastic membrane 23, but it also can move under the application of a pressure P2 through the port 17, during other operations than the heating here above described. It may be of interest during other operations to control the position of the elastic membrane 23 to minimize the volume of the deformable chamber 24, for example, during an operation of wetting the filter 25 or pumping the liquid out of the deformable chamber 24. To this end, the heater 15 is moved upwards under the pressure P2 applied through the port 17 of the instrument 10, so that the elastic membrane 23 is pushed against the filter 25. In this configuration, the liquid contained in the deformable chamber 24 is expelled out, as shown by the arrows at the outlet 22.

It is understood that obvious improvements and/or modifications for one skilled in the art may be implemented, being under the scope of the invention as it is defined by the appended claims. In particular, it is mentioned that the heating is a heating by conduction, however, another known methods may be used such as heating by convection or radiation.

Having described the invention, the following is claimed:

1. System for performing biological analysis, said system comprising:

a cartridge having a deformable chamber for containing a liquid to be analyzed, wherein the deformable chamber has a non-expanded state and an expanded state;

a heater having a heating face pushed in contact with the deformable chamber by an elastic element and arranged to heat the liquid contained in the deformable chamber, the heating face moveable from a first position to at least a second position, different from the first position, wherein the deformable chamber in the expanded state moves the heating face from the first position to the second position, thereby compensating for an increase of pressure in the deformable chamber during heating of said liquid by said heater; and an instrument for controlling the cartridge, said instrument having an interface plate, wherein the instrument applies a vacuum force to the cartridge to maintain the cartridge on the interface plate during the biological analysis.

2. System according to claim 1, wherein the instrument further comprises:

command means for allowing the heating face of the heater to move from the first position to the at least second position during heating of the liquid, and for maintaining the heating face of the heater at the first position when operations other than heating the liquid are performed.

3. System according to claim 2, wherein the command means includes a pneumatic cylinder.

4. System according to claim 1, wherein the cartridge further comprises:

an elastic membrane arranged on an external face of the cartridge, wherein:

a portion of the elastic membrane is a wall of the deformable chamber, the deformable chamber includes a filter, and the heating face of the heater is arranged to push the portion of the elastic membrane forming the wall against the filter during an operation of wetting the filter.

5. System according to claim 1, wherein the heating face of the heater is deformable.

6. System according to claim 1, wherein the heater is arranged in the interface plate of the instrument.

7. System according to claim 1, wherein the heater is arranged in the cartridge.

8. Instrument for a system for performing biological analysis, said system including a cartridge having a deformable chamber for containing a liquid to be analyzed, wherein the deformable chamber has a non-expanded state and an expanded state, said instrument comprising:

an interface plate for pneumatic control of the cartridge, wherein the cartridge is maintained on the interface plate during the biological analysis by a vacuum force applied to the cartridge by the instrument, and a heater having a heating face pushed in contact with the deformable chamber by an elastic element and arranged to heat the liquid contained in the deformable chamber, the heating face of the heater moveable from a first position to at least a second position, different from the first position, wherein the deformable chamber in the expanded state moves the heating face from the first position to the second position, thereby compensating for an increase of pressure in the deformable chamber during heating of said liquid by said heater.

9. Cartridge for a system for performing biological analysis, wherein said system includes an instrument for controlling the cartridge, said instrument having an interface plate, wherein the cartridge is maintained on the interface plate during the biological analysis by a vacuum force applied by the instrument to the cartridge, said cartridge comprising:

a deformable chamber for containing a liquid to be analyzed, wherein the deformable chamber has a non-expanded state and an expanded state; and a heater having a heating face pushed in contact with the deformable chamber by an elastic element and arranged to heat the liquid contained in the deformable chamber, the heating face of the heater moveable from a first position to at least a second position, different from the first position, wherein the deformable chamber in the expanded state moves the heating face from the first position to the second position, thereby compensating for an increase of pressure in the deformable chamber during heating of said liquid by said heater.

* * * * *